United States Patent [19]

Shikamori et al.

[11] Patent Number: 4,691,538

[45] Date of Patent: Sep. 8, 1987

[54] FULLY AUTOMATIC WASHING MACHINE

[75] Inventors: Tamotsu Shikamori, Juo; Hiroyuki Toshimitsu, Hitachi; Hiroshi Ohsugi, Hitachi; Isao Hiyama, Hitachi; Soichi Fukuzawa, Hitachi, all of Japan

[73] Assignee: Hitachi, Ltd., Tokyo, Japan

[21] Appl. No.: 834,393

[22] Filed: Feb. 28, 1986

Related U.S. Application Data

[60] Division of Ser. No. 575,785, Feb. 1, 1984, which is a continuation of Ser. No. 347,311, Feb. 9, 1982, abandoned.

[30] Foreign Application Priority Data

Oct. 7, 1981 [JP] Japan ..... 56-158779

[51] Int. Cl.[4] ..... D06F 33/02; D06F 39/02

[52] U.S. Cl. ..... 68/12 R; 68/17 A; 68/23.7

[58] Field of Search ..... 68/12 R, 23.7, 133, 68/4, 17 A, 18 FA, 134

[56] References Cited

U.S. PATENT DOCUMENTS 2,982,120 5/1961 Pelensky ..... 68/17 A X 3,369,381 2/1968 Crane et al. ..... 68/12 R 3,648,486 3/1972 Rosinski, Jr. et al. ..... 68/134 X 4,232,536 11/1980 Koseki et al. ..... 68/12 R

FOREIGN PATENT DOCUMENTS 1074061 6/1967 United Kingdom ..... 68/17 A

*Primary Examiner*—Philip R. Coe

*Attorney, Agent, or Firm*—Antonelli, Terry & Wands

[57] ABSTRACT

A fully automatic washing machine having a washing/drying cell rotatably mounted in an outer cell, a rotary blade unit provided on the bottom of the washing/drying cell and provided with a cylindrical member mounted thereon, and a washing machine motor adapted to rotate the blade unit in forward and backward directions during washing and rinsing and, to rotate the washing/drying cell at a high speed in one direction during drying. The ratio of the outside diameter of the rotary blade unit to the inside diameter of the washing/drying cell is selected to range between 0.6 and 0.8. The speed of rotation of the rotary blade unit is selected to fall within the range of between 100 and 250 rpm. The time length of rotation of the washing machine motor in each of forward and backward directions is selected to be less than 1 second.

6 Claims, 34 Drawing Figures

FULLY AUTOMATIC WASHING MACHINE

This is a division of application Ser. No. 575,785, filed Feb. 1, 1984, which was in turn a continuation of application Ser. No. 347,311, filed Feb. 9, 1982, and now abandoned.

BACKGROUND OF THE INVENTION

1. Field of the Invention

The present invention relates to a washing machine and, more particularly, to a fully automatic washing machine adapted to automatically perform the steps of washing, rinsing and drying.

2. Description of the Prior Art

In general, fully automatic washing machines proposed and used hitherto can be sorted into two types: namely, pulsator type machine in which a rotary blade unit is rotated in the washing and rinsing steps at a comparatively high speed in one and the other directions with a comparatively long interval of switching of rotation direction, and agitator type machine in which the rotary blade unit is rotated in the washing and rinsing steps at a comparatively low speed in one and the other direction at a comparatively low speed in one and the other directions with a comparatively short interval of switching of rotation direction.

More specifically, in the pulsator type washing machine, the direction of rotation of the rotary blade unit is switched at a long interval such that the rotation of the rotary blade unit is stopped for 3 seconds after a continuous forward rotation for 27 seconds and followed by a continuous backward rotation for 27 seconds. The rotation speed of each of forward and backward rotation is as high as 400 rpm. For these reasons, the pulsation type washing machines usually suffer the following problems.

(1) The wash is liable to be damaged because it is held for long time in contact with the rotary blade unit which rotates at a high speed.

(2) The wash, such as clothes or the like, are made to entangle with one another heavily so that it is often necessary to unfasten or loosen the clothes or the like before turning to the rinsing step or washing step.

(3) As the drying step is started following the rinsing step, an eccessively large unbalance of force is produced due to the entanglement of clothes which often results in an inconvenient stopping of the operation of the washing/drying machine.

(4) The entanglement of clothes results in an imperfect washing of the entangled portions by causing to cause uneven washing and rinsing.

The entanglement and the damage of clothes are not so great in the agitator type washing machines because in this case the rotary blade unit is rotated in the forward and backward directions within an angle less than 360° at a low speed. The agitator type washing machines, however, have the following drawbacks.

(1) The washing power is so limited that the contaminants of the clothes cannot be removed perfectly when the washing is made with cold water, i.e. unless warm water is used.

(2) A complicated mechanism is necessary for reciprocatingly rotating the rotary blade unit within the angle less than 360°. This complicated mechanism seriously lowers the productivity of the washing machine.

The present inventors have conducted a test with a washing machine in which the rotary blade unit has a greater diameter than the rotary blade unit of conventionally used pulsator type washing machine and a cylindrical member is attached to the rotary blade unit. The rotary blade unit was rotated in forward and backward directions at a speed lower than that in the conventionally used pulsator type washing machine. This washing machine proved to be able to overcome the problems such as entanglement and damaging of the clothes, but stiff suffered a problem that the wash such as clothes is inconveniently caught around the cylindrical member.

SUMMARY OF THE INVENTION

Accordingly, an object of the invention is to provide a fully automatic washing machine which undergoes reduced entanglement and damaging of clothes as compared with the pulsator type machines and which exhibits a greater washing power than the agitator type washing machine, while eliminating the twining of the clothes around the cylindrical member.

Another object of the invention is to provide a fully automatic washing machine in which, although the switching of rotation direction of the motor is effected by a single cam plate which turns the electric contacts one from the other and vice versa, it is possible to select a sufficiently short period or interval of the switching of rotation direction, with the washing machine incorporating an automatic timer which does not deteriorate the operation characteristics of the cam plate.

Still another object of the invention is to provide a fully automatic washing machine in which, although the rotary blade unit is switched between forward rotation and backward rotation in quite a short period of time, the level of noise is reduced and the undesirable locking of washing machine motor is prevented.

A further object of the invention is to provide a full automatic washing machine in which an automatic supply of a fabric conditioner and an automatic removal of rinsing agent can be made quite easily by making use of a cylindrical member provided on the central portion of the rotary blade unit.

To these ends, according to the invention, there is provided a fully automatic washing machine comprising: an outer shell; an outer cell mounted in a vibration damping manner in the outer shell; a washing/drying cell rotatably mounted in the outer cell; a rotary blade unit rotatably mounted on the center of the bottom of the washing/drying cell; a washing machine motor mounted at the bottom of the outer cell, the motor being adapted to rotate in the washing or rinsing step at a low speed in the forward and backward directions and to rotate at a high speed in one direction in the drying step; a clutch mechanism adapted to transmit the rotation of the motor shaft to the rotary blade unit in the washing and rinsing step and to the washing/drying cell in the drying step; a speed reducing gear for reducing the speed of rotation transmitted from the motor to the rotary blade unit; a water supply device adapted to supply the washing/drying cell with water; a draining device for draining the outer cell; and an automatic timer adapted to operate the washing machine motor, water supplying device and the draining device in accordance with a predetermined program chart; the rotary blade unit being provided at its central portion with a cylindrical member, the outside diameter d of the cylindrical member being determined in relation to the inside diameter D of the washing/drying cell such that the ratio d/D takes a value ranging between 0.6 and 0.8, the speed of rotation of the rotary blade unit being set to fall within the range of between 100 rpm and 250 rpm, the period of rotation of the washing machine motor being selected to be shorter than 1 second in each of the forward rotation and backward rotation.

Many other objects of the invention will become clear from the following description of the preferred embodiments and those skilled in the art will be able to enjoy various advantages other than mentioned above if they carry out the invention in the forms as set forth in the claims.

DESCRIPTION OF THE PREFERRED EMBODIMENTS

A preferred embodiment of the invention will be explained hereinunder with reference to the accompanying drawings.

Figure 1:
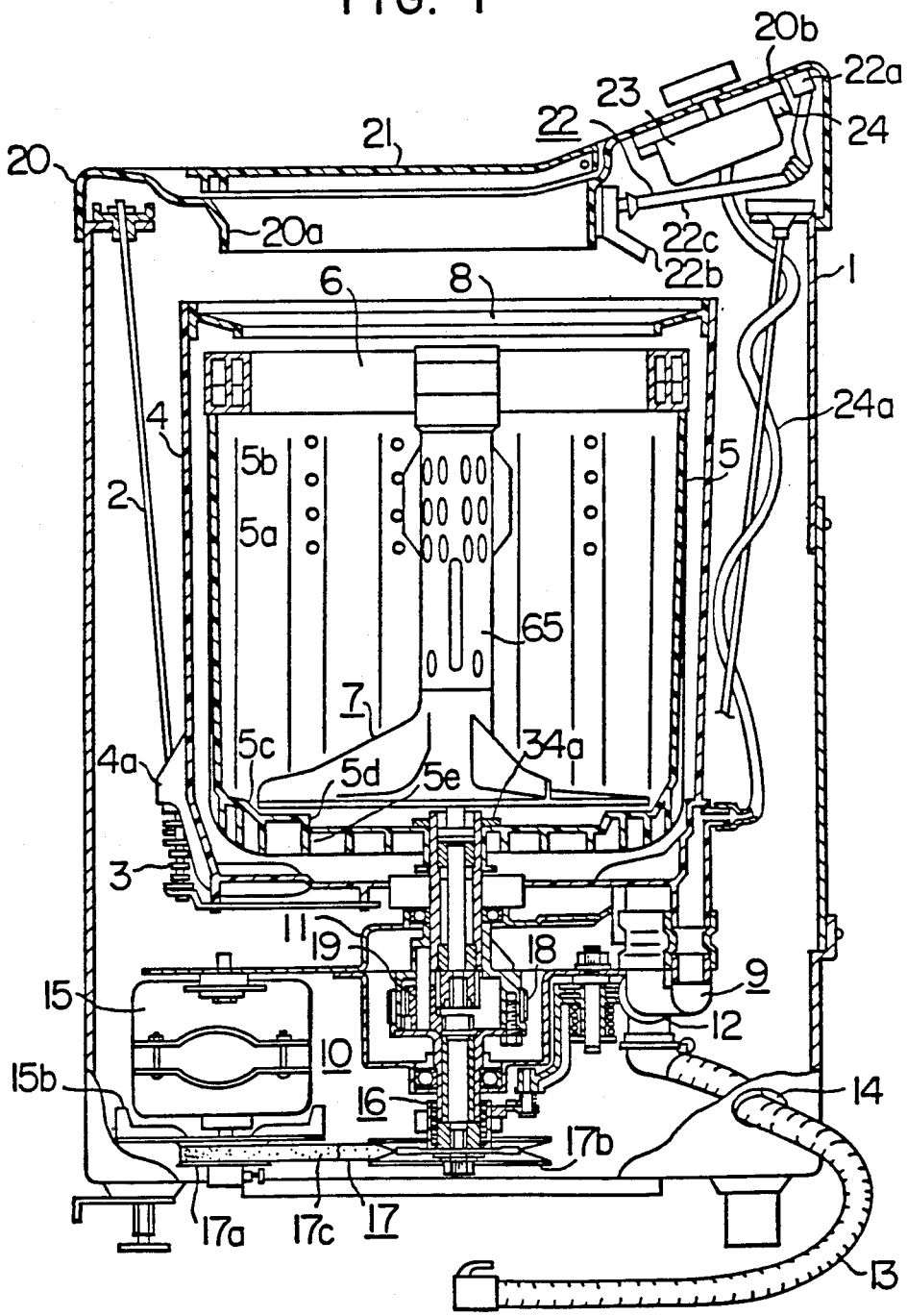
FIG. 1 is a vertical sectional view of an essential part of a washing machine in accordance with an embodiment of the invention.

Referring first to FIG. 1, a fully automatic washing machine in accordance with an embodiment of the invention has an outer shell 1 formed of steel plates and having a box-like form. An outer cell 4 made of a plastic is supported in a vibration damping manner within the outer shell 1 by means of suspension rods 2 and vibration damping springs 3 which are secured to ribs 4*a* formed on the side walls of the outer cell 4. A washing/drying cell 5, made of a plastic and having a substantially circular cross-section, is placed in the outer cell 4. A balance ring 6, made of a plastic, is attached to the upper end of the washing/drying cell 5 by friction welding. A multiplicity of vertical grooves 5*a* are formed in the inner peripheral surface of the washing/drying cell 5 at a constant circumferential pitch. Each vertical groove 5*a* is provided with a multiplicity of dehydration holes 5*b*. At the center of the bottom of the washing/drying cell 5, formed are a first recess 5*c* for mounting a later-mentioned large rotary blade unit 7 and a second recess 5*d* for mounting a small rotary blade unit used in the pulsator type automatic washing machine. A plurality of stiffening or reinforcement ribs 5*e* are formed on the outer surfaces of the side wall and bottom wall of the washing/drying cell 5.

An annular cover 8 is fixed to the upper end of the outer cell 4. The annular cover 8 is adapted to prevent the wash from dropping into the gap between the outer cell 4 and the washing/drying cell 5. A draining device 9 and a driving device 10 for rotatingly driving the rotary blade unit 7 and the washing/drying cell 5 are secured to the outer bottom surface of the outer cell 4 by means of an upper supporting member 11 made of a steel plate. As will be seen from FIG. 2, the upper supporting member 11 has a substantially cross-like form and is fixed to the outer bottom surface of the outer cell 4 by means of screws.

Figure 2:
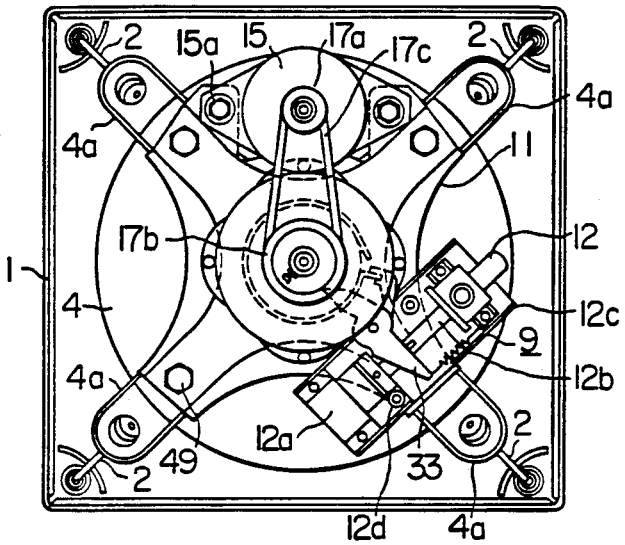
FIG. 2 is a bottom plan view of the washing machine shown in FIG. 1.

The draining device 9 is provided with a draining valve 12 connected to the inner bottom surface of the outer cell 4 and a draining hose 13 connected to the draining valve 12. The opening and closing of the draining valve 12 is performed by an operation rod 12*b* adapted to be actuated by a solenoid 12*a*. The draining valve 12 is attached to a mounting plate 12*c* as shown in FIG. 2. The mounting plate 12*c* is secured to the upper supporting member 11 by means of screws 12*d*. The draining hose 13 leads to the outside of the outer shell 1 through a hole 14 formed in the wall of the latter.

As will be seen from FIG. 1, the driving device 10 includes a washing machine motor 15, a clutch mechanism 16, a transmission mechanism 17 for transmitting the torque of the motor 15 to the clutch mechanism 16, a brake device for braking the rotation of the washing-/dehydration cell 5, and a speed reducing gear 19 for transmitting the rotation of the shaft of the motor 15 to the rotary blade unit 17 at a reduced speed. As will be seen from FIG. 2, the washing machine motor 15 is secured to the upper supporting member 11 by means of screws 15*a*.

The transmission mechanism 17 includes a first pulley 17*a* fixed to the shaft of the washing machine motor 15, a second pulley 17*b* provided at the lower part of the clutch mechanism, and a belt 17*c* stretched between the first pulley 17*a* and the second pulley 17*b*. A fan 15*b* for cooling the washing machine motor 15 is formed integrally with the first pulley 17*a*.

A top cover 20 made of a plastic and having an opening 20*a* for putting the clothes into the washing machine is fixed to the upper end of the outer shell 1 as shown in FIG. 1. The opening 20*a* is adapted to be opened and closed by an upper lid 21 made of a plastic. The upper lid 21 may be secured to the top cover 20 to move between the opening position and closing position or, alternatively, formed as a separate body and detachably fitted to the opening 20*a*. A panel box 20*b* is formed on the rear side of the top cover 20 integrally therewith. The panel box 20*b* houses an automatic timer 23 for controlling the washing machine motor 15, draining device 9 and the water supplying device 22, as well as a pressure switch 24. An air pipe 24*a* made of vinyl and wound round the suspension rod 2 is connected to the pressure switch 24. The air pipe 24*a* is secured to the lower part of the side wall of the outer cell 4 and is adapted to transmit the change in the water pressure at the bottom of the outer cell 4. The water supplying device 22 includes a water supplying valve 22*a* provided in the panel box 20*b*, a water pouring member 22 for pouring the water in the form of shower to the center of inner bottom of the washing/drying cell 5, and a water conduit 22*c* for introducing the water from the water supplying valve 22*a*. A water supplying hose connected to a faucet is secured to the water supplying valve 22*a* from the upper side of the panel box 20*b*.

The clutch mechanism 16 has a function to rotate the rotary blade unit 7 in forward and backward directions during washing and rinsing and to rotate the washing/drying cell 5 together with the rotary blade unit 7 in one direction at a high speed during drying. As will be seen from FIG. 3, the clutch mechanism 16 includes a lower rotary shaft 27 fixed to the second pulley 17*b* by means of a nut 25 and a washer 26, a pulley boss 28 formed on the upper surface of the second pulley 17*b* integrally therewith, a lower hollow shaft 30 mounted on the outer periphery of the lower rotary shaft 27 through a small bearing 29 so as to oppose to the pulley boss 28, a coiled spring 31 wound round both of the pulley boss 28 and the lower hollow shaft 30, a coil collar 32 provided at the outside of the coiled spring 31, and a clutch lever 33 which engages with a gear-shaped claw 32*a* provided on the outer peripheral surface of the coil collar 32 through the medium of a ratchet mechanism. The lower rotary shaft 27 is provided with a collar 27*a* which abuts the small bearing 29 to prevent the lower rotary shaft 27 from moving downwardly.

The pulley boss 28 has an outside diameter substantially equal to that of the lower hollow shaft 30. The coiled spring 31 is wound around the pulley boss 28 and the lower hollow shaft 30 with certain tightening margins, and makes an engagement at its one end with the coiled collar 32. A ratchet mechanism formed on one end of the clutch lever 33 is constituted by an engaging piece 33*a*, an attaching pin 33*b* for rotatably attaching the engaging piece to the clutch lever 33 and a torsion spring 33*c* adapted to permit the engaging piece 33*a* to rotate only in one direction. The clutch lever 33 is secured rotatably to a lower supporting member 48 by means of a fixing pin 33*d*, washer 33*e*, nut 33*f* and a coiled spring 33*g*. The other end 33*h* of the clutch lever 33 engages the operation rod 12*b* of the draining valve 12.

Figure 3:
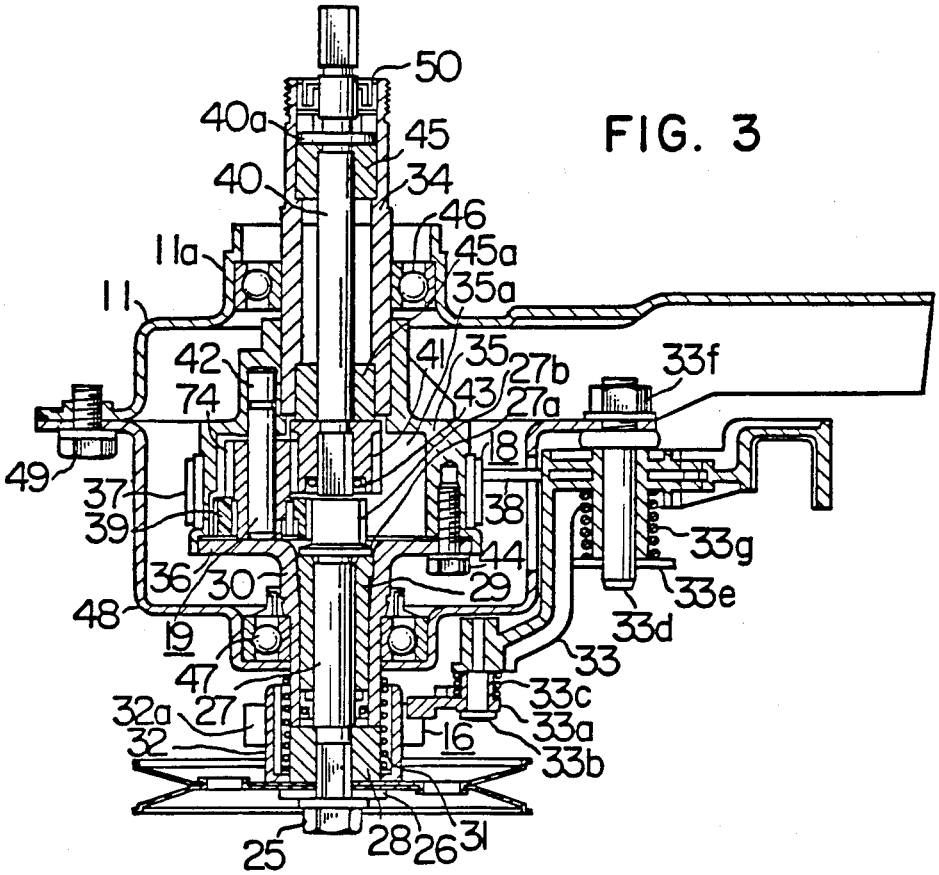
FIG. 3 is an enlarged sectional view of an essential part of the washing machine shown in FIG. 1.

As will be seen from FIG. 3, the brake device 38 includes an upper hollow shaft 34 fixed to the outer bottom surface of the washing/drying cell 5, a brake drum 35 fixed to this shaft 34, a lid member 36 formed on the upper end of the lower hollow shaft 30 integrally therewith, a brake band 37 wound around the brake drum 35, and a brake lever 38 connected to the brake band 37.

Figure 4:
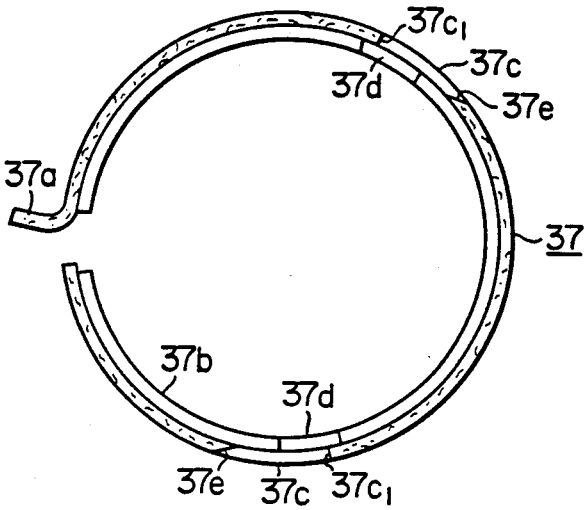
FIG. 4 is a cross-sectional view of a brake band.

As will be seen from FIG. 4, the brake band 37 has a bent end 37*a*. A brake lining 37*b* is bonded by a bonding agent to the inner surface of the brake band 37. The brake band 37 and the brake lining 37*b* are provided with a plurality of elongated holes 37*c* and 37*d*. A tapered surface 37*e* is formed in one end of the elongated hole 37*c*. The brake lever 38 is integrated with the clutch lever 33. As will be seen from FIG. 5, a recess 38*a* is formed in one end of the brake lever 38. In the state where the bent end 37*a* of the brake band 37 engages with the recess 38*a*, the brake drum 35 is rotatable only within an angle of 6° in forward and backward directions. The distance L between the end of the bent end 37*a* of the brake band 37 and the end of the brake lever 38 is selected to be 12 mm while the distance l between the end of the bent end 37*a* and the end of a projection 38*b* for forming the recess 38*a* is selected to be 3 mm. A tapered surface 38*c* is formed on the end of the brake lever 38.

As shown in FIG. 3, the speed reducing gear 19 includes a large gear 39 made of a plastic and screwed to a threaded portion 27*b* on the upper end of the lower rotary shaft 27, and a metallic small gear 41 which is fixed to the lower end of the upper rotary shaft 40 and meshing with a pinion 74 made of a sintered metal, the pinion 74 being formed integrally with the large gear 39. The speed reducing gear 19 as a whole is accomodated by a cavity 35*a* formed by the brake drum 35 and the lid 36.

The larger gear 39 is supported by a gear pin 42 rotatably in relation to the brake drum 35 and the lid 36. The small gear 41 is fixed to the upper rotary shaft 40 by means of a stopper ring 43. The lid 36 is secured to the brake drum 35 by means of a screw 44. The cavity 35*a* is charged with a lubricant such as a grease.

The upper rotary shaft 40 is disposed in the upper hollow shaft 34 and is supported by small bearings 45, 45*a*. A rotary blade unit 7 is detachably secured to the upper end of the upper rotary shaft 40. The upper hollow shaft 34 is rotatably mounted on the outer cell 4 by means of an upper bearing 46 secured to the upper supporting member 11. The lower hollow shaft 30 is rotatably secured to the lower supporting member 48 by means of a lower bearing 47. The lower supporting member 48 is fixed to the upper supporting member 11 by means of screws 49.

The upper hollow shaft 34 is fixed at its upper end to the center of bottom of the washing/drying cell 5 by a nut 34*a*. A seal 50 is provided between the upper inner end of the upper hollow shaft 34 and the upper rotary shaft 40. The upper rotary shaft 40 is provided with a collar 40*a* adapted to abut the small bearing 45 thereby to prevent the upper rotary shaft 40 from moving downwardly.

Figure 7:
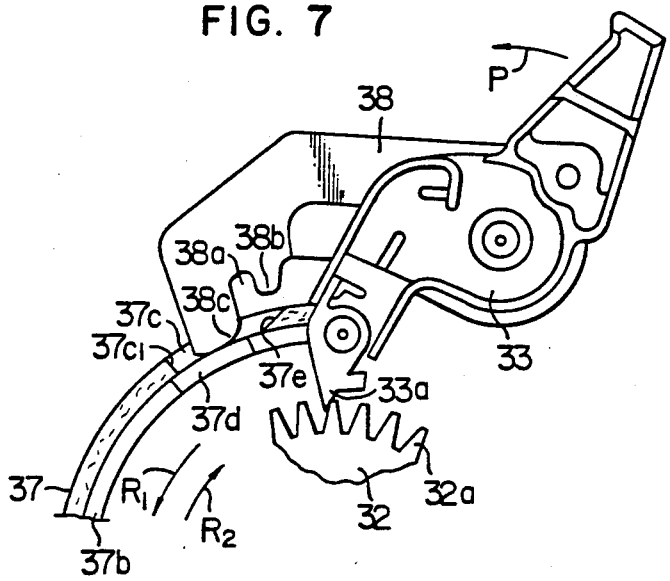
Figure 8:
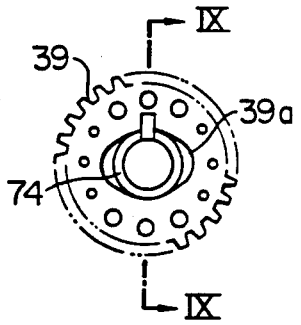
FIG. 8 is a bottom plan view of a large gear.
Figure 9:
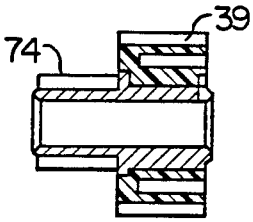
FIG. 9 is a sectional view taken along the line IX—IX of FIG. 8.

As shown in FIGS. 8 and 9, a pinion 74 is formed by insertion molding. An attatching hole 39*a* preferably has an oval shape as shown in FIG. 7. If the oval shape is not adopted, the wall of the hole 39*a* is preferably knurled.

Figure 10:
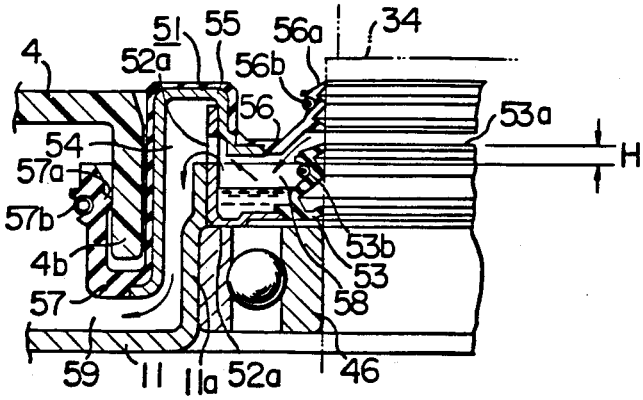
FIG. 10 is an enlarged sectional view of a water seal mechanism.
Figure 11:
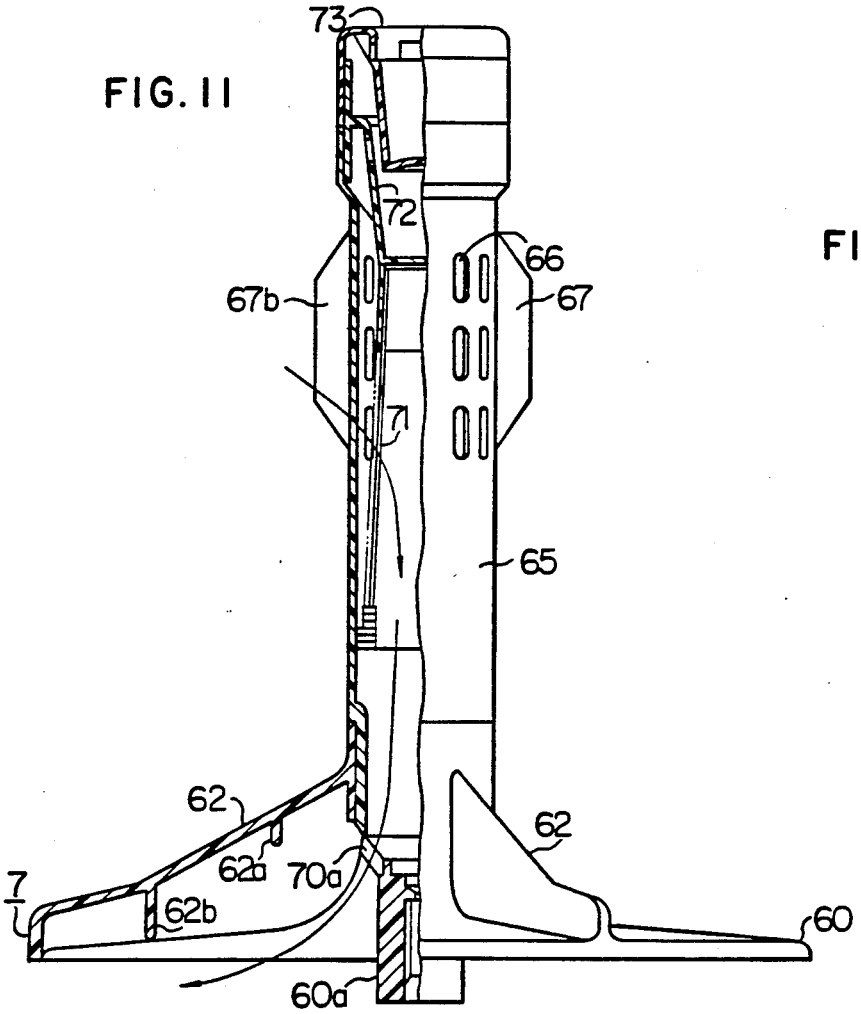
FIG. 11 is a partly sectioned front elevational view of a rotary blade unit provided with a cylindrical member.
Figure 13:
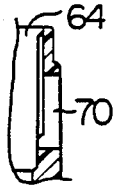
FIG. 13 is a sectional view taken along the line XIII—XIII of FIG. 12.
Figure 12:
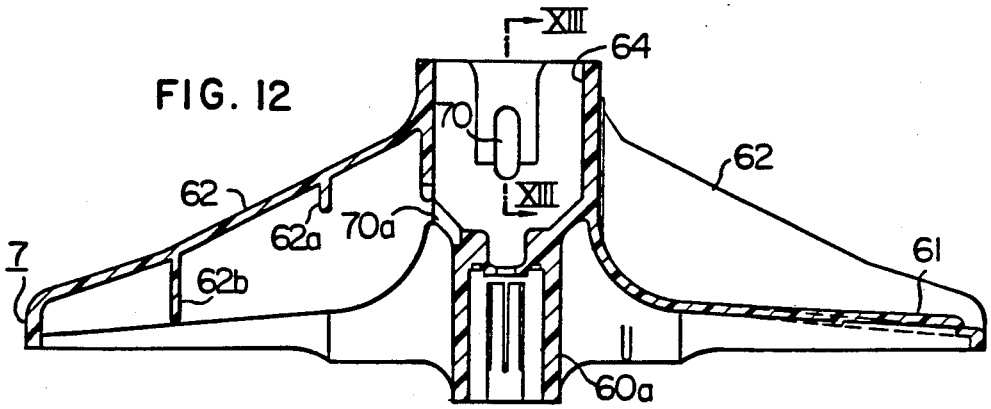
FIG. 12 is a vertical sectional view of the rotary blade unit.

As will be seen from FIG. 10, a water seal mechanism 51 is disposed between the upper hollow shaft 34 and the outer cell 4. The water seal mechanism 51 includes a ring-shaped core metal 52 provided on the upward brim 11*a* of the upper supporting member 11, a lower seal 53 made of rubber and provided on the core member 52, a core member 55 which defines a passage 54 at the outer side of the core member 52, an upper seal 56 made of rubber and provided at the inner side of the core 55 and an outer peripheral seal 57 made of rubber and provided at the outer side of the core member 55. The outer peripheral seal 57 has a lip 57*a* which is pressed against the central tubular portion 4*b* formed on the bottom of the outer cell 4 by means of a band 57*b*. The lower seal 53 and the upper seal 56 are provided with lips 53*a* and 56*a* which are pressed onto the outer peripheral surface of the upper hollow shaft 34 by means of bands 53*b* and 56*b*, respectively. A ring-shaped pocket portion 58 is disposed between the lower seal 53 and the upper seal 56. The core member 52 is provided with four to eight vent holes 52*a*. The distance H between the bottom of the vent hole 52*a* and the upper end of the lower seal 53 is selected to fall between 1 mm and 3 mm. The diameter of the vent hole 52 is selected to fall between 4 mm and 5 mm. The passage 54 is communicated at its upper portion with the vent holes 52*a* and at its lower portion with a vent passage 59 formed between the upper supporting member 11 and the outer peripheral seal 57.

Figure 14:
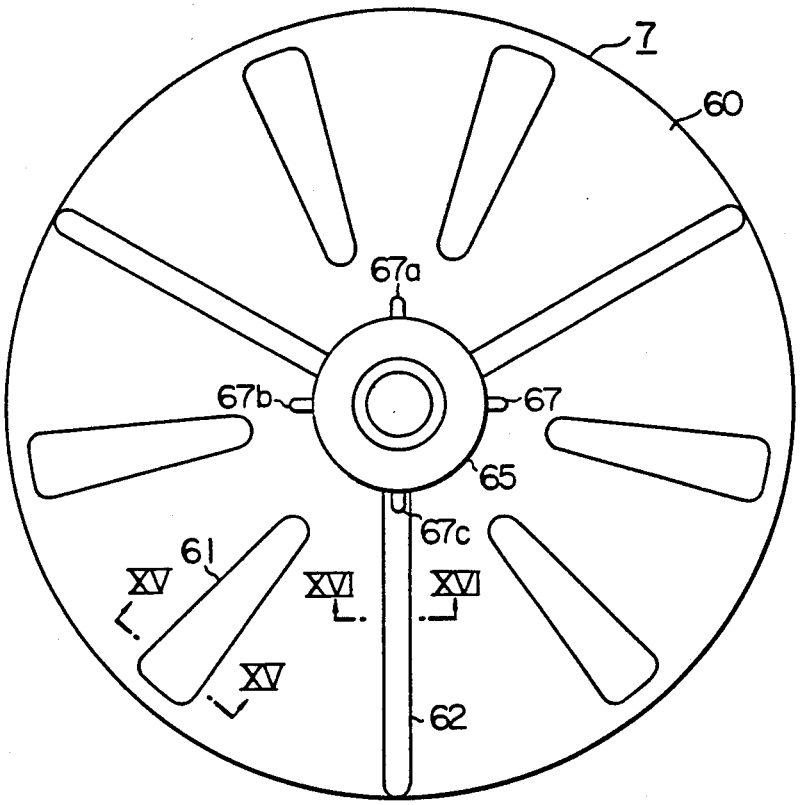
FIG. 14 is a plan view of the rotary blade unit.
Figure 15:
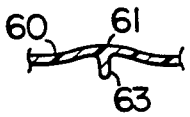
FIG. 15 is a sectional view taken along the line XV—XV of FIG. 14.
Figure 16:
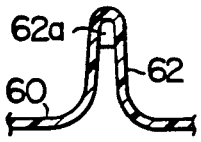
FIG. 16 is a sectional view taken along the line XVI—XVI of FIG. 14.

As shown in FIGS. 11 thru 16, the rotary blade unit 7, which is made of a plastic, has a disc-shaped base member 60, a plurality of small blades 61 formed on the upper surface of the base member 60, a plurality of large blades 62 formed on the upper surface of the base member 60 and a plurality of radial ribs 63 formed on the lower surface of the base member 60. The rotary blade unit 7 is so shaped that an equal water agitating or stirring effect is obtained when it is rotated forwardly and backwardly. The small blades 61 and the large blades 62 are arranged radially as shown in FIG. 14. As will be seen from FIG. 15, the ribs 63 are formed just under the small blades 61, while reinforcement ribs 62*a*, 62*b* are formed on the lower sode of the large blades 62. A fitting portion 60*a* for fitting the upper end of the upper rotary shaft 40 is formed at the center of the lower surface of the base member 60.

Figure 17:
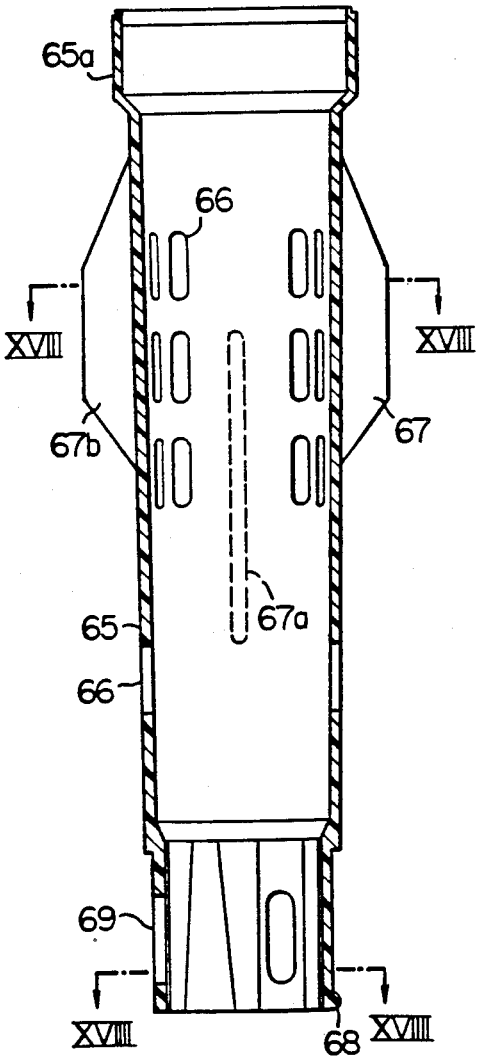
FIG. 17 is a vertical sectional view of the cylindrical member.
Figure 18:
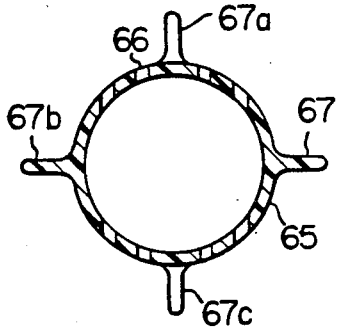
FIG. 18 is a sectional view taken along the line XVIII—XVIII of FIG. 17.
Figure 19:
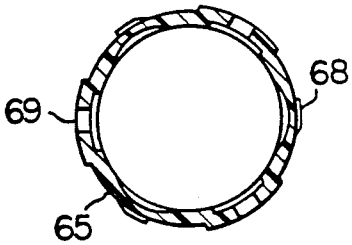
FIG. 19 is a sectional view taken along the line XIX—XIX of FIG. 17.

A cylindrical portion 64 formed at the center of the rotary blade unit 7 is detachably provided with a cylindrical member 65 made of a plastic. As will be seen from FIGS. 17 and 18, a multiplicity of elongated holes 66 and four projections 67, 67*a*, 67*b* and 67*c* of a size are formed on the side wall of the cylindrical member 56. The projections 67 and 67*b* are positioned at a level above the projections 67*a* and 67*c*. These projections 67, 67*a*, 67*b* and 67*c* are arranged on the side wall of the cylindrical member 65 such that an equal power for agitating or stirring the water in the washing/drying cell 5 is obtained when the cylindrical member 65 is rotated forwardly and backwardly. A claw for detachable engagement with the cylindrical portion 64 of the rotary blade unit 7 and a plurality of communication holes 69 are formed in the lower part of the wall of the cylindrical member 65. The communication holes 69 are aligned with communication holes 70 formed in the cylindrical portion 64 when the cylindrical member 65 is fitted to the cylindrical portion 64 of the rotary blade unit 7.

Figure 20:
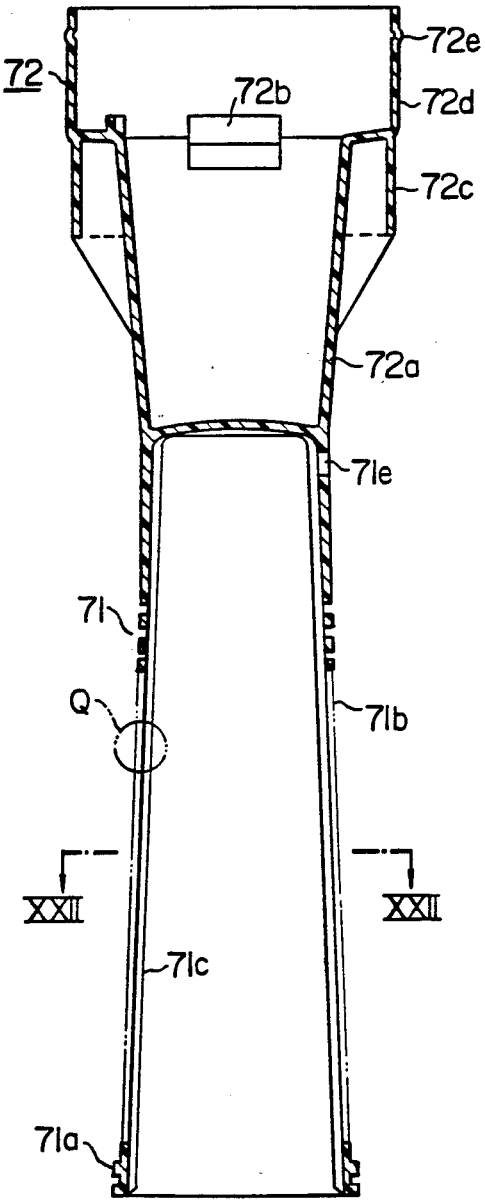
FIG. 20 is a vertical sectional view of an fabric conditioner supplying device.
Figure 21:
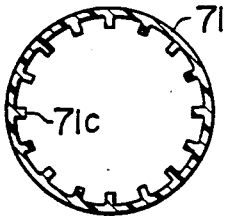
FIG. 21 is a sectional view taken along the line XXI—XXI of FIG. 20.
Figure 22:
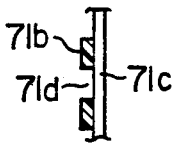
FIG. 22 is an enlarged sectional view of a portion marked at Q in FIG. 20.

An fabric conditioner supplying device 72, having a lint filter 71 made of a plastic, is detachably secured to the cylindrical member 65. As will be seen from FIG. 20, the fabric conditioner supplying device 72 has a vessel 72*a* made of a plastic and adapted to store a fabric conditioner, a plurality of discharge ports 72*b* formed in the upper end of the vessel 72*a*, a sack portion 72*c* provided at the outside of the discharge ports 72*b* and a lid fitting portion provided at an upper part of the vessel 72*a*. The inclination of the inner surface of the vessel 72*a* is so selected that the fabric conditioner is automatically discharged from the discharge ports 72*b* into the sack portion 72*c* when the vessel 72*a* is rotated at the speed of rotation of the rotary blade unit 7 during drying. The above-mentioned lint filter having a cylindrical form is unitarily secured to the lower side of the vessel 72*a*. The lower outer wall 71*a* of the lint filter 71 is pressed against the inner wall of the cylindrical member 65. As will be seen from FIGS. 21 and 22, the lint filter 71 has a screen 71*d* formed by a spiral rib 71*b* on the outer surface thereof and a multiplicity of vertical ribs 71*c* on the inner surface thereof. An air purge hole 71*e* is formed in the side wall portion through which the lint filter 71 is integrated with the vessel 72*a*.

Figure 23:
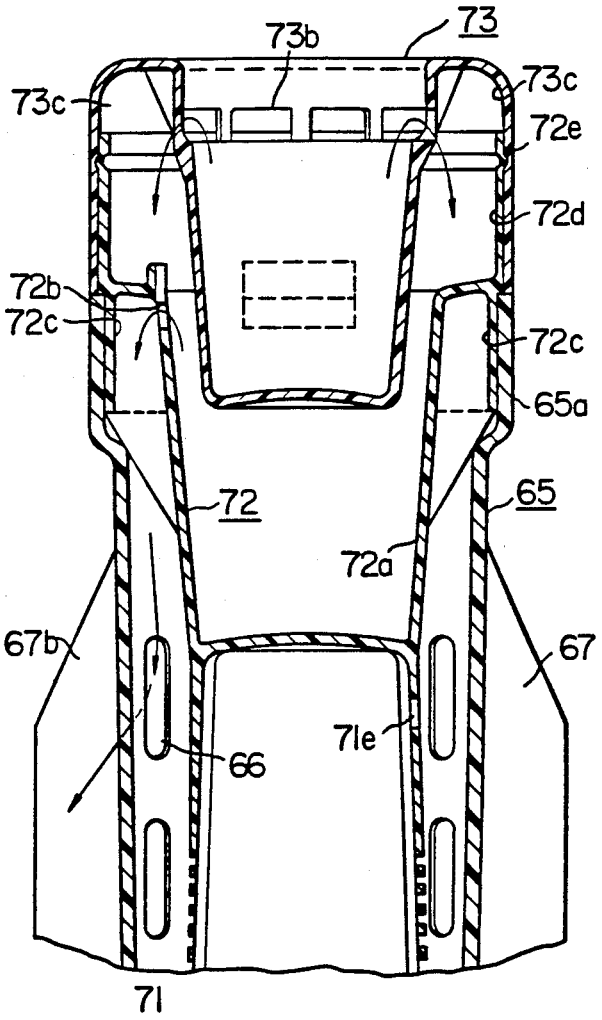
FIG. 23 is a sectional view of the fabric conditioner supplying device mounted on the cylindrical member.

The outer surface of the sack portion 72*c* is pressed against the inner surface of an enlarged portion 65*a* formed at the upper end of the cylindrical member 65. A lid 73 made of a plastic is detachably secured to the lid fitting portion 72*d*. As shown in FIG. 23, the lid 73 has a vessel 73*a* for storing the fabric conditioner, discharge ports 73*b* formed in an upper part of the vessel 73*a* and a sack portion 73*c* formed around the discharge ports 73*b*. The inner surface of the sack portion 73*c* makes a contact with the outer surface of the lid fitting portion 72*d*. Namely, the sack portion 73*c* of the lid 73 makes a snap fit to the lid fitting portion 72*d* by means of a ring-shaped projection formed on the latter. As the vessel 73*a* is rotated at a speed which is equal to the speed of the rotary blade unit 7 in the drying step, the fabric conditioner in the vessel 73*a* ascends along the inner surface of the vessel 73*a* and is discharged into the sack portion 73*c* through the discharge ports 73*b*. The fabric conditioner is then allowed to fall into the vessel 72*a* of the fabric conditioner supplying device 72 as the speed of rotation of the vessel 73*a* is lowered.

The automatic lint removing device is constituted by the elongated holes 66 formed in the wall of the cylindrical member 65, the cylindrical lint filter 71 integrated with the lower surface of the vessel 72*a* of the fabric conditioner supplying device 72 and the rotary blade unit 7 which makes a pumping action for returning the water which has passed through the lint filter 71 via the elongated holes back to the washing/drying cell 5. A communication hole 70*a* is formed in the cylindrical portion 64 of the base member 60 of the blade unit, so that the water in the washing/drying cell 5 is recycled past the elongated holes 66, lint filter 71, lower side of the rotary blade unit 7 and then the inside of the washing/drying cell 5, as the rotary blade unit 7 rotates.

Figure 24:
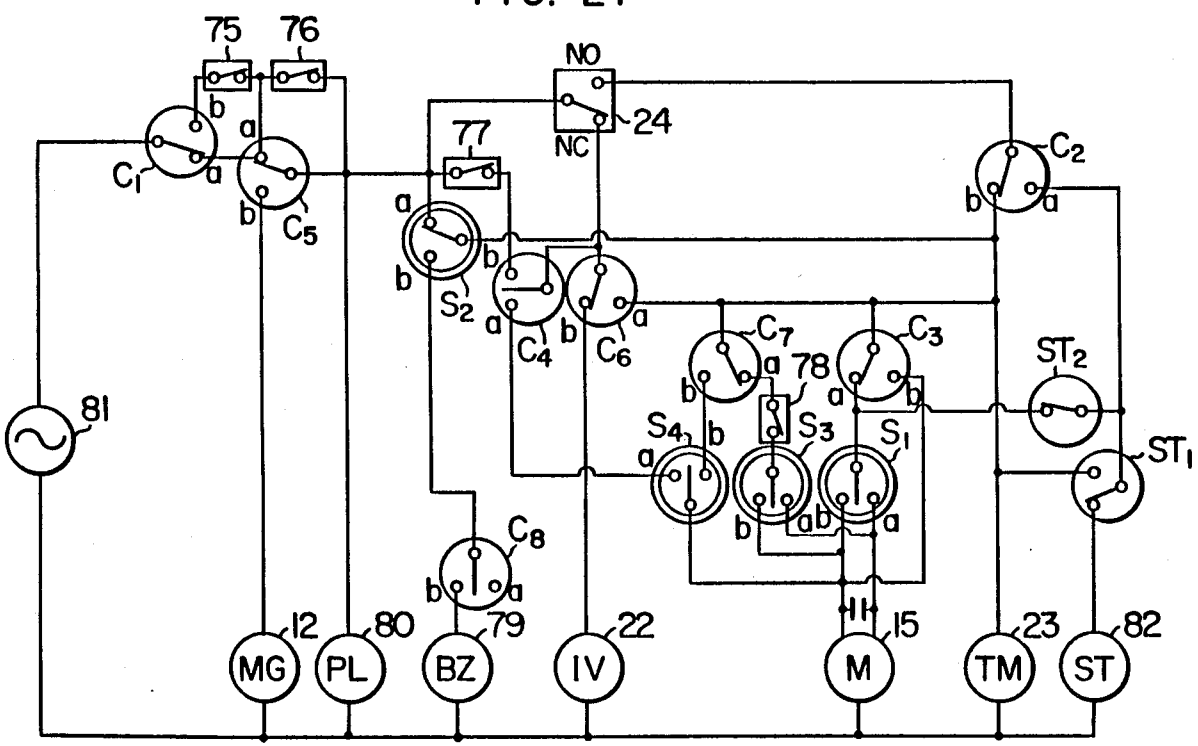
FIG. 24 is an electric circuit diagram.
Figure 25:
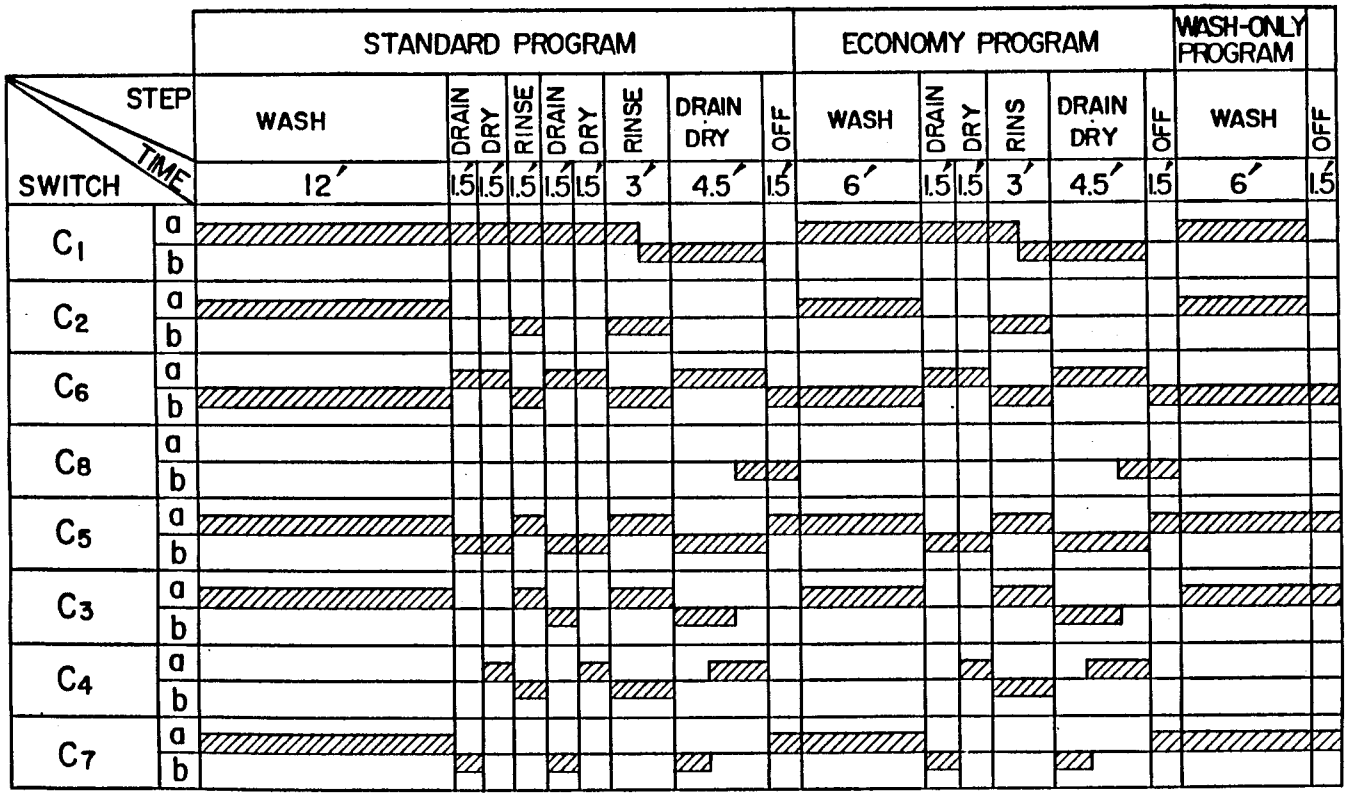
FIG. 25 is a time chart showing the operation of a cam switch of an automatic timer.

FIG. 24 shows an example of the electric circuit incorporated in the fully automatic washing machine of the invention. In this circuit, there are provided eight cam switches $C_1$, $C_2$, $C_3$, $C_4$, $C_5$, $C_6$, $C_7$ and $C_8$ which are adapted to switch the contacts in accordance with a program shown in the program chart in FIG. 25. Also, provided are four inversion switches $S_1$, $S_2$, $S_3$ and $S_4$ which are adapted to switch the contacts in accordance with the program shown in FIG. 26. The switching of contacts in these switches $C_1$ to $C_8$ and $S_1$ to $S_4$ are made by cam plates incorporated in an automatic timer 23. As shown in FIGS. 28A, 28B, 28C and 28D, the inversion switches $S_1$ and $S_3$ are adapted to be operated by a single cam plate 83 to switch their contacts 83*a* and 83*b* thereby to switch the direction of rotation of the shaft of the washing machine motor 15.

A manual stop switch 75 is adapted to be used when it is necessary to stop the rinsing operation conducted immediately before the final drying operation, as well as the final drying operation itself. A lid switch 76 has a function to automatically stop the drying operation when the upper lid 21 covering the opening 20*a* for putting the clothes into the washing machine is accidentally opened during the drying. A manual rinse change-over switch 77 permits a switching between the overflow rinsing mode and the pool rinsing mode.

A manual water-flow change-over switch 78 is connected in series to the inversion switch $S_3$. As the water-flow change-over switch 78 is opened, the time length of electric power supply to the washing machine motor 15 is shortened to provide weak flow of water. To the contrary, as the water-flow change-over switch is closed, the time length of electric power supply to the washing machine motor 15 is increased to provide strong flow of water.

The inversion switch $S_4$ has a function to stop the electric power supply to the washing machine motor 15 immediately before the completion of the drying operation thereby to sufficiently lower the speed of rotation of the brake drum 35 by the time at which the brake device 18 comes into effect. A buzzer 79 goes out before the completion of the drying operation to inform the user of the completion of execution of the program. A pilot lamp 80 is for informing the use of the connection of the electric circuit to the power supply 81.

Figure 27:
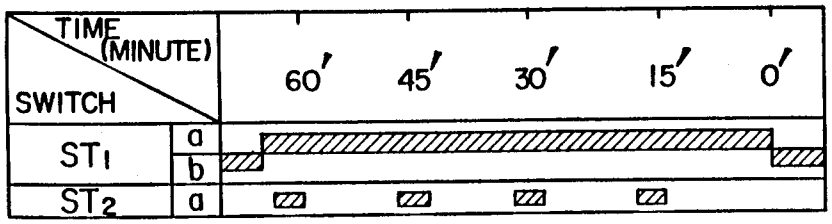
FIG. 27 is a time chart for the soak timer.
Figures 28A, 28B, 28C, 28D:
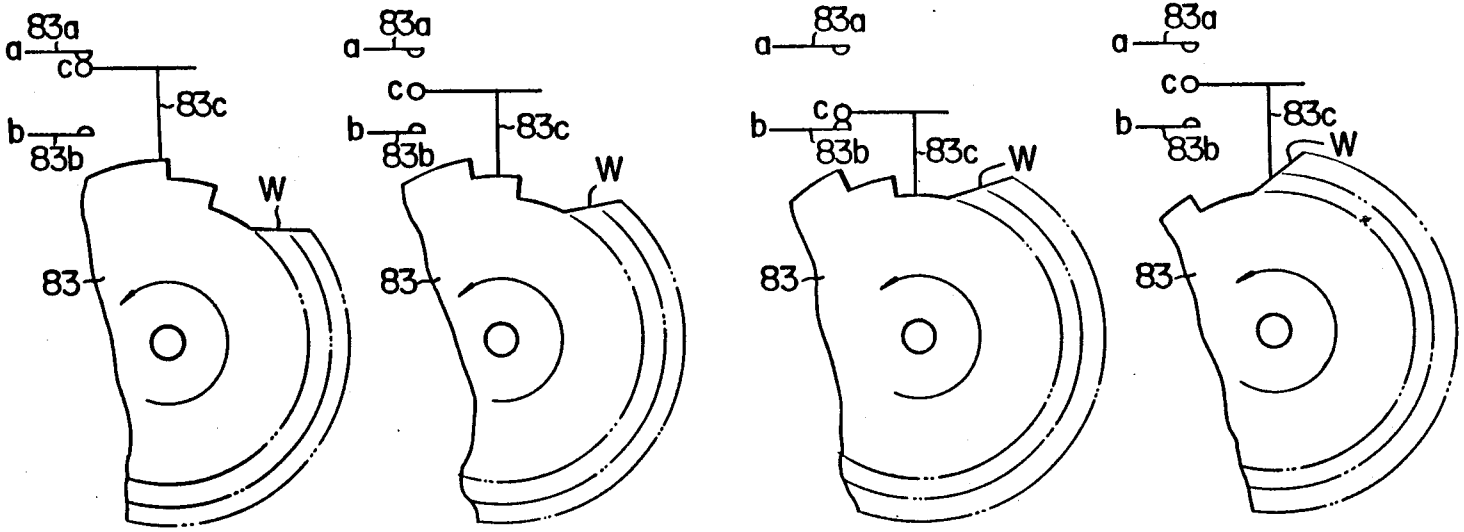
FIGS. 28A, 28B and 28C 28D are illustrations of operation of a cam plate of the automatic timer.

A soak timer 82 is adapted to turn on and off soak cam switches $ST_1$ and $ST_2$ in accordance with the program shown in FIG. 27. By setting the soak timer 82 before commencing the washing step, the wash is dipped in still water for a so-called soak washing over a time length set by the soak timer 82 and then the washing step is started. In the soak washing controlled by the soak timer 82, the washing machine motor 15 is rotated to stir the water and the wash only when the soak cam switch $ST_2$ is kept closed.

The manual stop switch 75, rinse change-over switch 77, water-flow change-over switch 78, buzzer 79 and the pilot lamp 80 are arranged on the upper face of the panel box 20*b*. As will be seen from FIG. 25, the automatic timer 23 permits the selection of a program out of three programs, namely: a standard program, economy program and wash-only program.

More specifically, the standard program, which takes 27 minutes, includes a washing step having water supply and washing operation, an intermediate dehydration step having draining and intermittent dehydration, a rinsing step having water supply and rinsing operation, and a final drying step having draining and continuous drying. The economy program, which takes shorter time than the standard program, is suitable for washing of clothes or the like having light degree of contamination. In the wash-only program the washing step consisting of water supply and washing operation is performed solely. This operation mode is suitable for a prewashing of the wash having heavy contamination or when it is desired to use the washing water repeatedly.

The period of inversion of the inversion switches $S_1$ and $S_3$ are selected such that the rotation of the washing machine motor in each of the forward and backward directions continues for a time length less than 1 second. The outside diameter d of the rotary blade unit 7 is so determined in relation to the inside diameter D of the washing/drying cell 5 such that the ratio d/D takes a value ranging between 0.6 and 0.8. The speed reduction ratio of the speed reducing gear 18 is selected such that the revolution speed of the rotary blade unit 7 to the washing and rinsing steps falls between 100 rpm and 250 rpm. The speed reduction ratio of the transmission mechanism is so selected to make the washing/drying cell 5 rotate at a speed ranging between 880 rpm and 900 rpm in the drying step. The outside diameter of the cylindrical member 65 is selected to be between 40 mm and 50 mm. The length of the cylindrical member 65 is so selected that the lid 73 provided on the upper end of the cylindrical member 65 is positioned above the maximum level of the water in the washing/drying cell 5.

In operation of the full automatic washing machine of the invention having the described construction, for washing clothes or the like of an ordinary degree of contamination, the automatic timer 23 is set to select the standard program, so that the water supplying valve 22*a* is opened to permit the fresh water to be supplied into the washing/drying cell 5. As the cell 5 is filled with water to a predetermined level, the pressure switch 24 is operated to close the water supplying valve 22*a* so that the rotary blade unit 7 is rotated in the forward and backward directions at a short period of switching thereby to execute the washing step. As the washing step is over, the washing machine motor 15 is de-energized while the draining valve 12 is opened to drain the outer cell 4. As the water level in the outer cell 4 is lowered to a predetermined level, the washing machine motor 15 is operated intermittently to execute the intermediate drying step. As the intermediate drying step is completed, the water is supplied again into the washing/drying cell 5. As the cell 5 is filled with water to a predetermined level, the pressure switch 24 is turned on to start the rotary blade unit 7 thereby to commence the rinsing operation either in the overflow mode or pool mode as selected by the rinsing change-over switch 77. It is possible to freely select the strong water flow or weak water flow by operating the water-flow change-over switch 78 during rinsing.

As the rinsing step is over, the above-mentioned intermediate drying operation and the rinsing operation are executed once and, thereafer, the program proceeds to the final drying step in which the washing machine motor 15 operates continuously.

A test result showed that, provided that the revolution speed of the rotary blade unit 7 is set to be between 100 and 250 rpm in the washing and rinsing step, and that the ratio d/D between the outside diameter d of the rotary blade unit 7 and the inside diameter D of the washing/drying cell 5 is selected to range between 0.6 and 0.8, the entanglement of clothes with one another can be suppressed to such a level that these clothes are easily loosened from one another as they are simply lifted from the washing/drying cell 5, if the time length of rotation of the washing machine motor 15 in each direction is less than 1 second. Therefore, the undesirable heavy entanglement of the clothes in the washing/drying cell 5 after the washing and rinsing can be avoided to permit a smooth switching to the drying step. For the same reason, the undesirable stopping of the washing/drying cell 5 due to excessively large unbalance of mass is avoided, and it becomes unnecessary to take the labour of loosening the entangling clothes. The reduced tendency of entanglement also reduces the uneven washing and rinsing effect. The washing power or effect can be maintained not smaller tnan 70% of that performed by the conventional pulsator type washing machines, which is much superior to that of the conventional agitator type washing machine. The undesirable twining of the clothes or the like around the cylindrical member 65 on the center of the rotary blade unit 7 can be completely avoided provided that the time length of rotation of the washing machine motor 15 in each direction is within 1 second.

The power input to the motor does not exceed 400 W or so even when the rotary blade unit 7 provided with the cylindrical body 65 is rotated in both directions at a high frequency of switching of the rotation direction as in the described embodiment. It is, therefore, not necessary to increase the capacity of the washing machine motor 15 and the motor used in the conventional pulsator type washing machine can be used as it is in the washing machine of the invention.

According to the invention, the fabric conditioner supplying device 72 and the automatic lint removing device can be incorporated in the cylindrical member 65, so that it is not necessary to process the outer cell 4 and the washing/drying cell 5 for mounting these devices. This economically permits the use of the outer cell and the washing/drying cell of the conventional pulsator type washing machine.

In the described embodiment of the invention, the time length of rotation of the washing machine motor 15 in each direction is set to be less than 1 second. In the case where the cylindrical member 65 is detached from the rotary blade unit 7, however, the time length can be prolonged to 3 seconds because, in such a case, it is not necessary to take the measure for preventing twining of the clothes around the central cylindrical member 65. The time length of rotation of the motor 15 in excess of 3 seconds is not recommended because, in such a case, the water is undesirably scattered away from the upper opening of the outer cell 4 to make the washing machine practically unusable.

Figure 26:
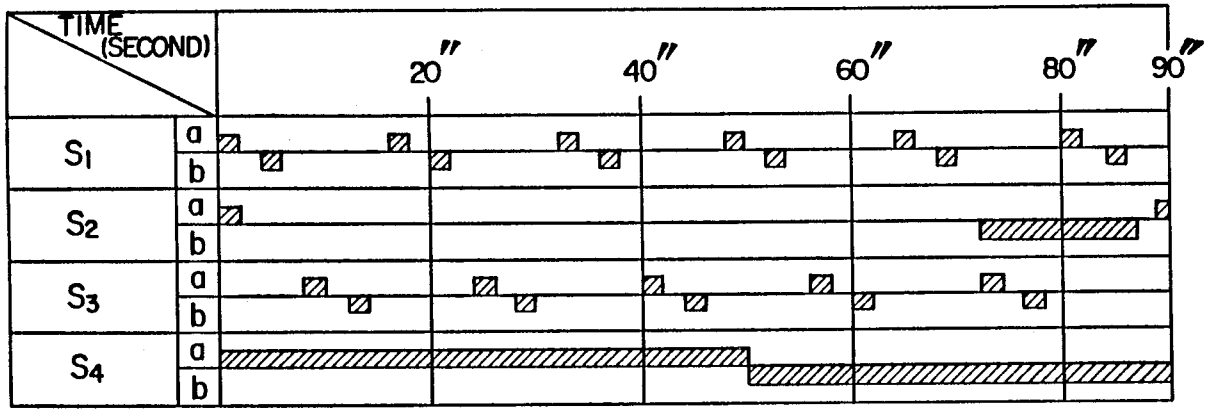
FIG. 26 is a time chart showing the operation of an inversion switch of the automatic timer.

In the described embodiment, the contacts a, b of the inversion switch $S_1$ and the contacts a, b of the inversion switch $S_3$ are energized alternatingly as shown in FIG. 26. It is, therefore, possible to substantially double the durability of the contact as compared with the case where the inversion switch $S_1$ is used solely. In addition, partly because the time length of pause during the switching from the contact a to the contact b can be made sufficiently long and partly because the inversion switch $S_3$ can be operated within the period of this pause, it is possible to make the angle of inclination of the tapered surface W of the cam plate 28 (See FIG. 28) sufficiently small. This in turn permits a smooth sliding of the contact legs 83 (See FIG. 28) of the inversion switches $S_1$ and $S_3$ slide smoothly along the cam surface of the cam plate 83. In addition, since the contact a of the inversion switch $S_3$ can be closed at any desired timing during the pause of the inversion switch $S_1$, it is possible to set the time length of pause of the washing machine motor 15 precisely at such a short time length of less than one second. Thus, according to the invention, it is possible to set the time length of pause of the inversion switch sufficiently short and the operation characteristics of the cam plate for opening and closing the inversion switches are never deteriorated. In addition, it is possible to prolong the life of the inversion switches. It is, therefore, possible to obtain an automatic timer suitable for the fully automatic washing machine which can switch the rotation direction of the washing machine motor at a high frequency while maintaining the time length of rotation in each direction sufficiently short.

In the fully automatic washing machine of the described embodiment, there is provided an fabric conditioner supplying device 72 which can automatically supply the fabric conditioner in the rinsing step preceding the final drying step, whichever of the standard program and the economy program may be selected.

The operation of this fabric conditioner supplying device 72 will be explained hereinunder with reference to FIG. 23.

The vessel 73*a* is charged with the softener before the execution of the standard program. In the washing step, the fabric conditioner is held in the vessel 73*a* of the lid 73 because the speed of rotation of the cylindrical member is low and because the latter is reversed in quite a short period of time. As the drying step is commenced, however, the fabric conditioner is made to flow along the inner surface of the vessel 73*a* and discharge through the discharge ports 73*b* into the sack portion 73*c* because the cylindrical member 65 rotates at high speed. The fabric conditioner is held within the sack portion 73*c* while the drying operation is continued but is made to fall into the vessel 72*a* of the fabric conditioner supplying device 27 as the drying operation is finished. Then, in the subsequent first rinsing operation, the fabric conditioner still remains in the vessel 72 because the cylindrical member 65 is rotated at a low speed and high frequency of switching of rotation direction. Then, as the second drying operation is started after the completion of the first rinsing operation, the fabric conditioner is transferred to the sack portion 72*c* through the discharge ports 72*b*. Then, as the second drying operation is over, the fabric conditioner is made to fall from the sack portion 72*c* into the cylindrical member 65 and is discharged therefrom through the elongated holes 66 in the cylindrical member 65 to be dispersed in the water supplied into the washing/drying cell 5 in the last rinsing step, i.e. in the rinsing step immediately before the final drying operation.

For executing the economy program, the lid 73 is detached from the fabric conditioner supplying device 72 and the fabric conditioner is charged directly into the vessel 72*a*. Then, in the same manner as in the standard program, the fabric conditioner is dispersed into the water in the rinsing step immediately before the final drying step, through the discharge ports 72*b* and the sack portion 72*c*. It is thus possible to change the mode of supply of the fabric conditioner between the standard program mode and the economy program mode simply by detaching the lid 73. This feature is quite advantageous in the fully automatic washing machine.

Figure 5:
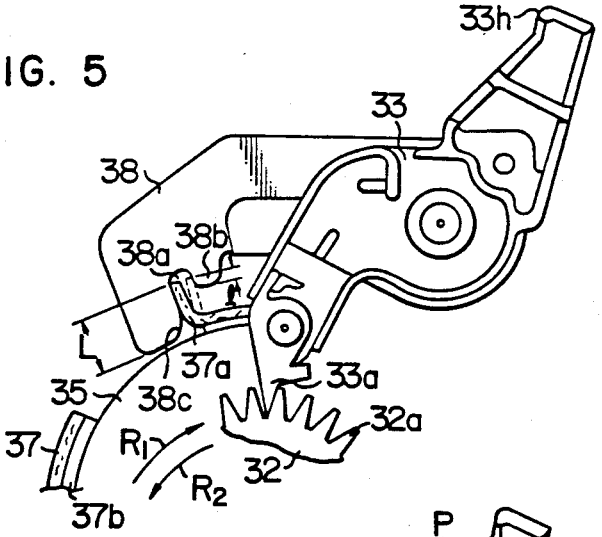
FIGS. 5 to 7 are illustrations of operation of a braking device.

Hereinafter, an explanation will be made as to the operation of the brake device 18 incorporated in the fully automatic washing machine of this embodiment, with specific reference to FIGS. 5 thru 7. Assuming that the rotary blade unit 7 is rotating clockwise in the washing step, the brake band 37 is rotated as indicated by an arrow $R_2$ so that the bent end 37*a* of the brake band 37 comes into engagement with the recess 38*a* of the brake lever 38 thereby to brake the brake drum 35. To the contrary, in the case where the rotary blade 7 rotates counter-clockwise, so that the bent end 37*a* of the brake band 37 comes into engagement with the projection 38*b* of the brake lever 38 thereby to brake the brake drum 35. Therefore, the range of angular movement of the brake drum 35 can be made to fall within an extremely small range determined by the distance over which the bent end 37*a* is allowed to rotate within the recess 38. As a result, the noise of impact between the bent end 37*a* and the recess 38 is reduced. In fact, a test result showed that the impact noise can be maintained at a level lower than 53 dB even though the rotation direction of the rotary blade unit 7 was switched at a high frequency in a short period of time.

Figure 6:
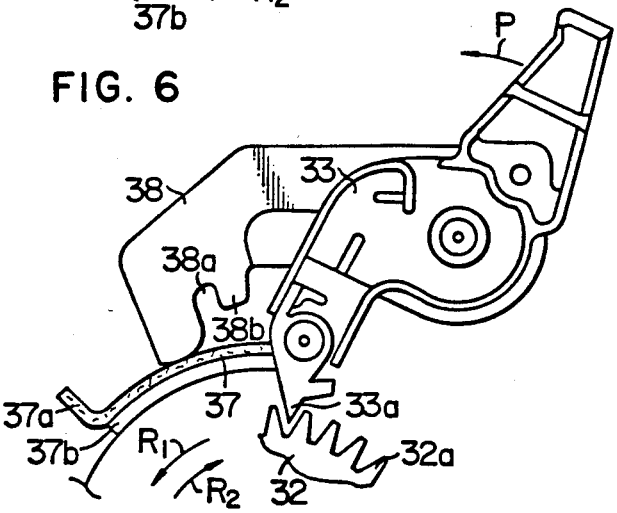

In the washing step, when the brake lever 38 and the brake band 37 take the positions shown in FIG. 6, the clutch lever 33 cannot rotate sufficiently in the direction of arrow P, so that it is not possible to make the engaging piece 33*a* engage the claw 32*a* of the coil collar 32 sufficiently. In consequence, the coiled spring 31 keeps tight twinding round the pulley boss 28 and the lower hollow shaft 30. However, as the rotary blade unit 7 is rotated in the direction for loosening the coiled spring 31, i.e. in the direction of the arrow $R_2$, the washing/drying cell 5 and the brake drum 35 are rotated in the direction of the arrow $R_1$ so that the end of the brake lever 38 drops into the elongated holes 37*c* and 37*d*. As the rotary blade unit 7 is reversed in this state to make the brake drum 35 rotate in the direction of the arrow $R_2$, the end of the brake lever 38 is brought into engagement with one end $37C_1$ of the elongated hole 37C and the clutch lever 33 is allowed to rotate sufficiently in the direction of the arrow P. In consequence, the claw 32*a* is allowed to sufficiently engage the engaging piece 33*a*, so that the coiled spring 31 is loosened so as not to lock the washing machine motor 15. When the rotary blade unit rotates in the direction of the arrow $R_2$ while the brake drum 35 is rotating in the direction of the arrow $R_1$, the end of the brake lever 38 is allowed to slip out of the elongated hole 37C because the other end of the elongated hole 37C is tapered, and slides into the next elongated hole 37C. At the same time, the engaging piece 33*a* is freed from the claw 32*a* by the ratchet mechanism. At the same time, since the pulley boss 28 rotates in the direction for loosening the coiled srping 31, so that the washing machine motor 15 is never locked.

According to the invention, it is thus possible to avoid the undesirable locking of the washing machine motor 15 attributable to the reversing of the rotary blade unit 7, simply by providing elongated holes 37C in the brake band 37, and to obtain a brake device suitable for use in a fully automatic washing machine in which the rotation direction of the rotary blade unit 7 in which the rotary blade unit 7 is rotated for quite a short period of time in each direction and the rotation direction is switched at a high frequency.

The water seal mchanism 51 incorporated in the fully automatic washing machine of the invention offers the following advantages. Namely, in this case, the water evaporated by the friction heat generated as a result of sliding between the upper hollow shaft 34 and the upper seal 56 is conveniently discharged to the outside through the pocket portion 58, vent holes 52*a*, passage 54 and the vent hole 59. The vapor of the water, therefore does not flow through the space between the lower seal 53 and the upper hollow shaft 34, so that the undesirable rusting of the upper bearing 46 is perfectly avoided.

In the speed reducing gear 19 incorporated in the fully automatic washing machine of the invention, the large gear 39 made of a plastic meshes with the threaded portion 27*b* which rotated at a high speed, so that the chrttering noise is reduced considerably. The large gear 39 has a sufficient stretgth and, hence, can be used without breakdown because a metallic pinion 74 is formed by insertion molding integrally therewith.

Figure 29:
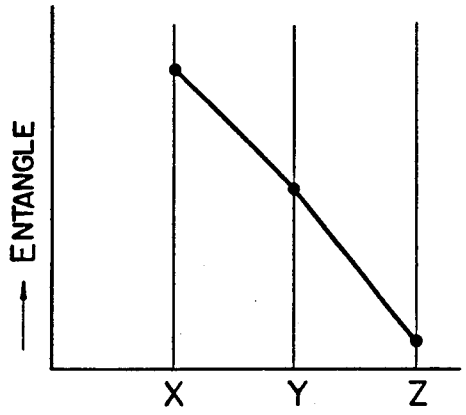
FIGS. 29 to 31 are charts for showing the washing performance of washing machine of pulsator type in comparison with that of the washing machine of agitator type.
Figure 30:
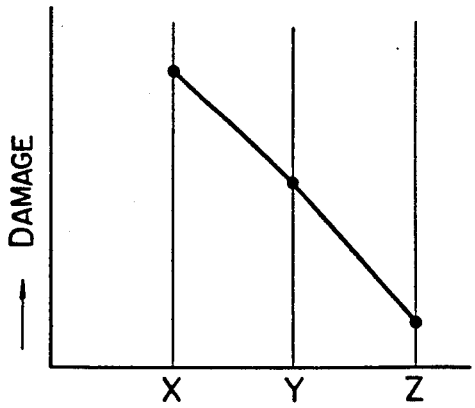
Figure 31:
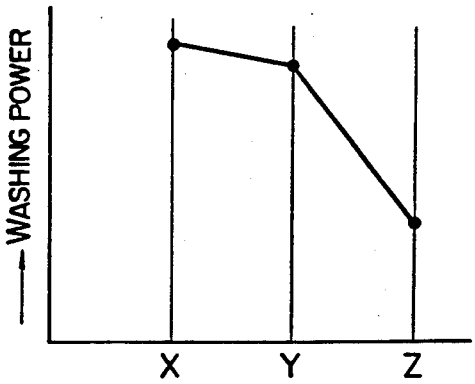

A practical example of the fully automatic washing machine of the present invention has dimensions as shown in the following Table. FIGS. 29 to 31 show the result of a test conducted with this washing machine.

| | | |
|---|---|---|
| Washing/drying cell | inside diameter | 410 mm |
| | capacity of cell | 3.2 Kg |
| | water level | 320 mm |
| rotary blade unit | outside dia. | 320 mm |
| | revolution speed (no load) | 180 to 190 rpm |
| | switching period | 0.8 sec (on) −0.5 sec (off) |
| cylindrical member | outside dia. | projects above water level by 50 to 70 mm |

In FIGS. 29 thru 31, the point X represents the values as obtained with the conventional pulsator type washing machine, Y represents the values as obtained with the washing machine of the invention and Z represents the values as obtained with the conventional agitator type washing machine. As will be seen from FIGS. 29 to 31, the washing machine of the invention exhibits a smaller tendency of entanglement of the wash and damaging of the same as compared with the pulsator type washing machine, while maintaining a washing power or effect much higher than that of the conventional agitator type washing machine and well comparing with that of the pulsator type washing machine. It is also to be noted that, in the washing machine of the invention, the amount of water scattered and the amount of overflow of water in the washing step are as small as less than 0.1 cc and 0.18 l, respectively.

In addition, the invention can be carried out by adding a set of inversion switches and a cam plate and varying the rotation speed of the rotary blade unit, period of switching of direction of rotation of the rotary blade unit and the shape of the same, while modifying a part of the brake device. Thus, the automatic washing machine of the invention can make use of various parts common to the conventional pulsator type washing machines to a great advantage from an economical point of view.

As has been described, according to the invention, it is possible to obtain a fully automatic washing machine having a rotary blade unit with a cylindrical member, capable of remarkably suppressing the tendency of the entanglement and damaging of the wash as compared with the pulsator type washing machine and having a stronger washing power or effect than the agitator type washing machines, while avoiding the undesirable twining of the wash round the central cylindrical member on the rotary blade unit.

What is claimed is:

1. A fully automatic washing machine comprising:

an outer shell;

an outer cell supported in said outer shell in a vibration damping manner;

a washing/drying cell rotatably mounted in said outer cell;

a rotary blade unit rotatably provided on a central portion of an inner bottom surface of said outer cell;

a washing machine motor secured to the bottom of said outer cell and adapted to rotate in forward and backward directions in a washing step and a rinsing step and, in a drying step, at a high speed only in one direction;

a clutch mechanism adapted to transmit a torque of said washing machine motor to said rotary blade unit in said washing step and in said rinsing step and to said washing/drying cell in said drying step;

a speed reducing gear adapted to transmit the torque of said washing machine motor to said rotary blade unit at a reduced speed in the forward and backward directions;

a water supplying valve for supplying said washing/drying cell with water;

a draining valve for draining said outer cell; and an automatic timer adapted to operate said washing machine motor, water supplying valve, and said draining valve in accordance with a predetermined program chart;

characterized in that said rotary blade unit is provided at a center of the upper surface thereof with a cylindrical member, and in that said cylindrical member is provided with a fabric conditioner supplying device capable of supplying a fabric conditioner into said washing/drying cell in the rinsing step taken immediately before said final drying step in a standard program including a plurality of intermediate drying steps and associated rinsing steps operated after said washing step, said standard program includes a first intermediate drying step, a first rinsing step, a second intermediate drying step, and a second rinsing step sequentially operated after a washing step, said fabric conditioner supplying device includes a first vessel for storing said fabric conditioner and a lid detachably secured to said first vessel, said lid including a second vessel for also storing said fabric conditioner, at least one first discharge port provided at an upper portion of said first vessel higher than a water level in the rinsing step, at least one second discharge port provided at an upper portion of said second vessel, and a sack portion provided around said at least one second discharge port, and wherein when said first and second vessels are rotated at a speed equal to the speed of rotation of said rotary blade unit in said first intermediate drying step of high speed, said fabric conditioner in said second vessel flows up along the inner surface of said second vessel and is discharged into said sack portion through said at least one second discharge port, and then, in the first rinsing step of low speed, said fabric conditioner received in the sack portion falls into said first vessel, and next, in the second intermediate drying step, flows from said first vessel along an inner surface thereof and is discharged through said discharge ports into said washing/drying cell.

2. A fully automatic washing machine comprising:

an outer shell;

an outer cell supported in said outer shell in a vibration damping manner;

a washing/drying cell rotatably mounted in said outer cell;

a rotary blade unit rotatably provided on a central portion of an inner bottom surface of said outer cell;

a washing machine motor secured to the bottom of said outer cell and adapted to rotate in forward and backward directions in a washing step and a rinsing step and, in a drying step, at a high speed only in one direction;

a clutch mechanism adapted to transmit a torque of said washing machine motor to said rotary blade unit in said washing step and in said rinsing step and to said washing/drying cell in said drying step;

a speed reducing gear adapted to transmit the torque of said washing machine motor to said rotary blade unit at a reduced speed in the forward and backward directions;

a water supplying valve for supplying said washing/drying cell with water;

a draining valve for draining said outer cell; and an automatic timer adapted to operate said washing machine motor, water supplying valve, and said draining valve in accordance with a predetermined program chart;

characterized in that said rotary blade unit is provided at a center of the upper surface thereof with a cylindrical member, a ratio d/D between the outside diameter d of said rotary blade unit and the inside diameter D of said washing/drying cell falls within a range of between 0.6 and 0.8, a speed of rotation of said rotary blade unit is in a range of between 100 rpm to 190 rpm, a time length of rotation of the washing machine motor in each of the forward and backward directions is less than three seconds and in that said cylindrical member is provided with a fabric conditioner supplying device capable of supplying a fabric conditioner into said washing/drying cell in the rinsing step taken immediately before said final drying step in a standard program including a plurality of intermediate drying steps and associated rinsing steps operated after said washing step, wherein said standard program includes a first intermediate drying step, a first rinsing step, a second intermediate drying step, and a second rinsing step sequentially operated after a washing step, said fabric conditioner supplying device includes a first vessel for storing said fabric conditioner and a lid detachably secured to said first vessel, said lid including a second vessel for also storing said fabric conditioner, a plurality of first discharge ports provided at an upper portion of said first vessel higher than a water level in the rinsing step, a plurality of second discharge ports provided at an upper portion of said second vessel, and a sack portion provided around said second discharge ports, and wherein, when said first and second vessels are rotated at a speed equal to the speed of rotation of said rotary blade unit in said first intermediate drying step of high speed, said fabric conditioner in said second vessel flows up along the inner surface of said second vessel and is discharged into said sack portion through said second discharge ports, and then, in the first rinsing step of low speed, said fabric conditioner received in the sack portion falls into said first vessel, and next, in the second intermediate drying step, flows from said first vessel along an inner surface thereof and is discharged through said discharge ports into said washing/drying cell.

3. A fully automatic washing machine as claimed in claim 2, wherein said sack portion of said lid fits at an inner surface thereof around an outer surface of a lid fitting portion provided at an upper portion of said vessel.

4. A fully automatic washing machine as claimed in claim 2, further comprising an automatic lint removing device including a plurality of elongated holes formed in the wall of said cylindrical member, a cylindrical lint filter integral with the lower surface of said vessel of said fabric conditioner supplying device, and said rotary blade unit which serves as a pump for recycling the water passing through said elongated holes and said lint filter back to the space in said washing/drying cell.

5. A fully automatic washing machine as claimed in claim 1, wherein said fabric conditioner supplying device is detachably mounted on said cylindrical member.

6. A fully automatic washing machine as claimed in claim 1, wherein said at least one first discharge port and said at least one second discharge port respectively include a plurality of ports.

* * * * *